US005842747A

United States Patent [19]

Winchester

[11] Patent Number: 5,842,747

[45] Date of Patent: Dec. 1, 1998

[54] APPARATUS FOR ROADWAY SURFACE RECLAIMING DRUM

[75] Inventor: Latham E. Winchester, Indianapolis, Ind.

[73] Assignee: Keystone Engineering & Manufacturing Corporation, Indianapolis, Ind.

[21] Appl. No.: 805,145

[22] Filed: Feb. 24, 1997

[51] Int. Cl.[6] ..... E21C 35/197

[52] U.S. Cl. ..... 299/87.1; 299/39.8; 299/104

[58] Field of Search ..... 299/39.4, 39.8, 299/87.1, 104, 106; 175/394

[56] References Cited

U.S. PATENT DOCUMENTS

| | | | |
|---|---|---|---|
| 2,197,549 | 4/1940 | Hargrave et al. | 299/25 |
| 4,139,318 | 2/1979 | Jakob et al. | 404/90 |
| 4,278,296 | 7/1981 | Bortz et al. | 299/87.1 |
| 4,311,284 | 1/1982 | Ratcliff, Jr. | 241/191 |
| 4,325,580 | 4/1982 | Swisher, Jr. et al. | 299/39.8 |
| 4,480,873 | 11/1984 | Latham | 299/87.1 |
| 4,693,517 | 9/1987 | Eisenbeis et al. | 299/87.1 |
| 4,697,850 | 10/1987 | Tuneblom | 299/87.1 |
| 5,052,757 | 10/1991 | Latham | 299/87.1 |
| 5,078,540 | 1/1992 | Jakob et al. | 404/90 |
| 5,098,167 | 3/1992 | Latham | 299/104 |
| 5,498,069 | 3/1996 | Siebenhofer et al. | 299/81.3 |

*Primary Examiner*—David J. Bagnell
*Attorney, Agent, or Firm*—Locke Reynolds

[57] ABSTRACT

An apparatus for a roadway surface reclaiming drum is disclosed that includes a plurality of flighting sections generally helically attached to a cylindrical surface of the drum at an included angle of about 40° to about 60°. During rotation of the drum about its cylindrical axis, a plurality of cutter bits mounted to openings defined in the flighting sections loosen roadway surface and the flighting sections transport loosened roadway material axially along the drum and between the flighting sections towards a lateral center portion of the drum. A plurality of teeth received in recesses defined in walls of the flighting sections facilitate transport of loosened roadway material between adjacent flighting sections towards the lateral center portion of the drum and reduce wear of the flighting sections. Cutter bit inserts for receiving the cutter bits are mounted to base portions attached to the outermost portions of the flighting sections, and define interior bores. Jamming fasteners are provided to secure the cutter bit inserts to the flighting sections against relative rotational movement.

21 Claims, 7 Drawing Sheets

APPARATUS FOR ROADWAY SURFACE RECLAIMING DRUM

BACKGROUND OF THE INVENTION

1. Field of the Invention

The present invention generally relates to the field of rotary driven cylindrical cutter devices and scarifiers for use in roadway surface reclaiming, earthworking, mining, or other in situ disintegration of hard materials. More particularly, the present invention is directed to such rotary driven cylindrical cutter devices and scarifiers as incorporate means for feeding or excavating the material cut or mined away from its initial location generally to a second material-carrying means.

2. Description of the Prior Art

Roadway resurfacing machines which include rotary driven cylindrical cutter devices and appropriate conveying apparatus entirely supported on a mobile ground engaging vehicular platform are described in Hargrave U.S. Pat. No. 2,197,549; Jakob et al. U.S. Pat. No. 4,139,318; Ratcliff, Jr. U.S. Pat. No. 4,311,284; Swisher, Jr., et al. U.S. Pat. No. 4,325,580; and Latham U.S. Pat. Nos. 4,480,873; 5,052,757; and 5,098,167.

In general, roadway surface mining, planing, or reclaiming equipment disclosed in the prior art includes a rotary driven cylindrical comminuting drum which acts to scarify and to mine the top portion of the asphaltic road surface in situ. The rotary driven drum includes flighting on the drum which acts to collect the mined material toward the center of the drum where it can be removed. Often the mined material is then remixed with additional bituminous material and thereafter redeposited as a newly formed smooth asphaltic surface.

In some prior art devices of this type, the flighting is formed from a plurality of cutter bit support members which are connected to the curved surface of the drum by bolts which pass from the upper surface of the flighting downward into the drum to engage threaded openings in the drum. Alternatively, the bolts may pass through the surface of the drum to engage lock washers and threaded nuts on the interior of the drum. A plurality of the cutter bit support members may be arranged end-to-end so as to form a substantially continuous helical flighting. The top surface of the helical flighting may be elevated above the curved surface of the drum, with the top surface including angled openings into which conventional cutter bits are received.

During use, abrasive forces, which often include rather high value sudden shocks, are transmitted from the cutter bits into the supporting members and the bolts securing the supporting members to the smooth drum surface. The forces occasionally become large enough to shear the securing bolts, causing the machine to be stopped for considerable lengths of time. Repair and replacement of the cutter bit supporting member damaged in this manner typically necessitates the use of an easy-out or similar removing tool in the field to remove the portions of the sheared bolts remaining in the drum. This is a time-consuming repair job which results in considerable expense to a roadway surface reclaiming machine operation.

In an attempt to avoid the problems presented by the bolt-secured supporting members, other roadway surface reclaiming devices include a continuous flighting welded in place in helical fashion on the surface of the drum. A plurality of individual cutter bit base portions may be welded to the upper edge of the flighting, with the base portion including an opening for receiving a cutter bit of a chisel cutter, preferably having a tungsten carbide tip or the like.

By increasing the rotational rate of the drum, the rate at which roadway surface may be reclaimed is also increased, resulting in greater economy to the roadway surface reclaiming operation. However, the rotational rate of the drum has an optimum value, beyond which the drum and related components are subject to increased rates of failure, necessitating time consuming repair.

In use, the cutter bits vibrate and otherwise move within the base portion opening. Particularly in the presence of abrasive dust from the roadway surface reclaiming operation, the vibration and movement of the cutter bits act to enlarge the openings to such an extent that the cutter bits are no longer retained. It then becomes necessary to remove the old base portions, usually with the aid of a cutting torch, and to weld new base portions in place. Again, this repair job is difficult to do in the field and still achieve accurate alignment of the base portions on the flighting section. Misalignment of the base portions results in undesirable lateral forces on new cutter bits which in turn results in very fast wear and ultimate failure of the replaced parts.

Cutter bits may be disposed in cutter bit inserts removably mounted to the base portions, for instance by threaded attachment. However, during drum rotation, cutter bits and cutter bit inserts are subject to unevenly distributed forces, tending to cause rotation of the cutter bit inserts with respect to the base portions, whereby the cutter bit inserts may be loosened from engagement with the base portions.

Despite the availability of such devices, there exists a need in the art for an apparatus for a roadway surface reclaiming drum that facilitates reclaiming roadway at an increased rate while the drum rotates at an optimum rate. Further, there exists a need in the art for an apparatus for a roadway surface reclaiming drum having a cutter bit insert that is capable of removable attachment to a base portion, yet is resistant to loosening upon rotation of the drum.

SUMMARY OF THE INVENTION

In order to aid in the understanding of the present invention, it can be stated in essentially summary form that it is directed to an apparatus for a roadway surface reclaiming drum that is capable of reclaiming roadway surface at an increased rate for a particular rate of rotation of the drum, and which includes a cutter bit insert removably attachable to a base portion and resistant to loosening therefrom upon rotation of the drum.

More specifically, in a first embodiment, the present invention provides an apparatus for use on a roadway surface reclaiming drum, including a plurality of flighting sections mounted to a cylindrical surface portion of the drum, for instance by welding, in circumferentially spaced-apart relation. The flighting sections may be formed from a plurality of flighting segments attached together, for instance, by segment welds, so that the flighting sections are disposed to generally helically wind around the cylindrical surface portion at an included angle in the range of about 40° to about 60° with respect to a cylindrical axis defined by the drum, and converge at a lateral central portion of the cylindrical surface portion. Further, the flighting segments preferably are attached to the drum so that a longitudinal axis defined by each flighting segment is disposed generally normal to the cylindrical surface portion.

For a drum having a diameter of approximately 34 inches and flighting segments radially extending approximately 9 inches from the cylindrical surface portion, the longitudinal axes of adjacent flighting segments form a circumferential angle of approximately 4° to 8° and preferably about 6°, and planes defined normal to the cylindrical axis and intersecting the longitudinal axes of adjacent flighting segments are separated by less than about 3 inches and preferably separated by about 2 inches. When four flighting sections are utilized, the flighting sections may be disposed on the cylindrical surface portion in circumferentially spaced-apart relation of approximately 90° between adjacent flighting sections.

A plurality of base portions, each including a mounting surface and a slanted surface, are mounted to radially outermost portions of the flighting sections, for instance by base portion welds, so that the mounting surfaces are adjacent to radially outermost portions and each base portion is aligned with a flighting segment. Side welds attach together adjacent base portions and help prevent loosened roadway material from moving between adjacent base portions. Each base portion defines an opening aligned with one of the longitudinal axes and is adapted to receive a cutter bit insert. Planes defined normal to the cylindrical axis defined by the drum intersects a plurality of flighting sections disposed at circumferential spacings along the cylindrical surface portion of the drum.

The flighting sections include an interior wall disposed generally normal to and projecting from the cylindrical surface portion and defining a plurality of generally cylindrical recesses. A plurality of generally cylindrical teeth are removably received in the recesses, with each recess defining a tooth axis. The tooth axes may be disposed substantially parallel to the cylindrical axis defined by the drum.

The opening defined by each base portion includes threads, a lower end, and a conical seat. Each cutter bit insert includes a gripping surface, a conical shoulder, a lower surface, defines an interior bore, and has external threads capable of threaded engagement with the threads of a base portion. The cutter bit inserts may be threadably engaged with the base portions, with the conical shoulders disposed in wedged frictional contact against the conical seats thereby helping to secure the cutter bit inserts to the base portions and keep the external threads from being under shock load during a cutting operation. The gripping surfaces allow for easy access for removal of the cutter bit inserts. The interior bore has an upper portion for removably receiving a cutter bit, and the external threads and the interior bore of the cutter bit insert may be disposed substantially coaxially. A threaded jamming fastener may be disposed in threaded engagement with the threads, and positioned between the lower end and the lower surface. The jamming fastener may be rotated with respect to the base portion by use of an appropriate tool in the fastener opening, and initially positioned proximate to the lower end of the base portion. A cutter bit insert may thereafter be threaded into the base portion, with the dimensions of the base portion, the cutter bit insert and the jamming fastener chosen so that an upper volume is defined between the jamming fastener and the lower surface. Using an appropriate tool disposed through the interior bore and into the fastener opening, the jamming fastener may be rotated and thereby translated towards the lower surface until the jamming fastener contacts the lower surface, thereby aiding in preventing relative rotational movement of the cutter bit insert with respect to the base portion. In order to replace the cutter bit insert, upon removal of a cutter bit from the interior bore, an appropriate tool may again be inserted through the interior bore and into the fastener opening, so that the jamming fastener may be rotated to translate away from contact with the lower surface and towards the lower end.

For a given optimum rotational rate of the drum, provision of additional flighting sections lying in a plane normal to the axis defined by the drum will increase the number of cutter bits that will contact the roadway surface during each revolution of the drum, with the result that the rate at which roadway surface is reclaimed will be significantly increased. Where a relatively greater number of flighting sections lying in planes normal to the cylindrical axis of the drum and disposed at a given included angle are present, the average perpendicular distance between adjacent flighting sections for a given size drum will be relatively smaller. On the other hand, movement of mined roadway material to the lateral center portion occurs between adjacent flighting sections, so that where the average perpendicular distance between adjacent flighting sections is relatively smaller, the amount of mined roadway material that can be efficiently moved therebetween is also relatively less. The desirable characteristic of increasing the rate at which roadway surface is mined by utilizing additional flighting sections that increase the number of the cutter bits contacting the roadway surface during each revolution of the drum may be limited by relatively smaller average perpendicular distances between adjacent flighting sections.

To further facilitate movement of loosened roadway surface between adjacent flighting sections towards the lateral center portion, and to reduce wear of the flighting sections through contact with loosened roadway material, the teeth may be provided in the recesses defined in the interior wall. Upon rotation of the drum and the flighting sections, loosened roadway material is urged towards the lateral center portion by contact with the teeth. As the drum rotates, the cutter bits loosen roadway surface and the flighting sections transport loosened roadway material axially along the drum and between the flighting sections, towards the lateral center portion. The teeth act to effectuate transport of loosened roadway material between adjacent flighting sections, and to reduce wear of the flighting sections by providing a wear face for the flighting sections. By removing worn teeth and replacing with new teeth, a renewed wear face may be provided for the flighting sections.

In a second embodiment of the present invention, the base portions define an access aperture extending between the slanted surface and an interior bottom surface. The cutter bit inserts include an interior aperture defined below the upper portion of the interior bore. The interior aperture is disposed in fluid connection with the access aperture, whereby pressurized fluid applied to the access aperture may bear against a cutter bit received in the interior aperture facilitating removal of the cutter bit from the interior aperture. Consequently, removal of the cutter bit from the cutter bit insert may be quickly and easily accomplished by applying compressed air or similar through the access aperture and into the interior aperture, with resulting pressure bearing against and facilitating removal of the cutter bit.

In a third embodiment of the present invention, the openings are defined in the flighting sections, so that the cutter bit inserts may then be threadably attached directly to the flighting sections.

It is an object of the present invention to provide an apparatus for a roadway surface reclaiming drum that facilitates mining roadway at an increased rate while the drum rotates at an optimum rate.

It is another object of the present invention to provide an apparatus for a roadway surface reclaiming drum having a cutter bit insert that is capable of removable attachment to a base portion, yet is resistant to loosening upon rotation of the drum.

It is still another object of the present invention to provide an apparatus for a roadway surface reclaiming drum that is of durable and sturdy construction, yet may be easily and rapidly serviced.

It is yet another object of the present invention to provide an apparatus for a roadway surface reclaiming drum that facilitates movement of loosened roadway material axially along the drum during rotation of the drum.

Further objects and advantages of the present invention will be apparent from a study of the following portion of the specification, the claims, and the attached drawings.

DESCRIPTION OF THE PREFERRED EMBODIMENTS

The following portion of the specification, taken in conjunction with the drawings, sets forth the preferred embodiments of the present invention. The embodiments of the invention disclosed herein are the best mode contemplated for carrying out this invention in a commercial environment, although it should be recognized and understood that various modifications can be accomplished within the parameters of the present invention.

Figure 1:
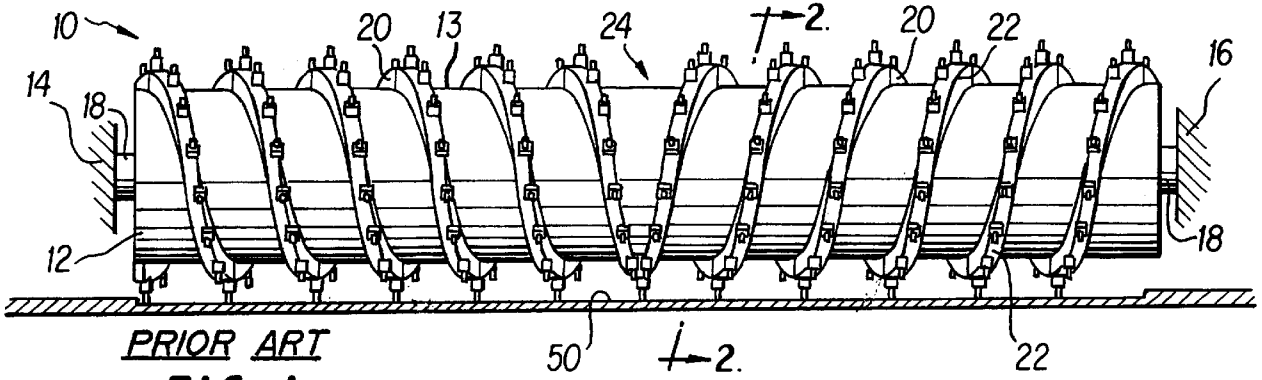
PRIOR ART FIG. 1
FIG. 1 is a front elevational view of a drum portion of a roadway surface reclaiming machine on which the present invention can be employed.
Figure 2:
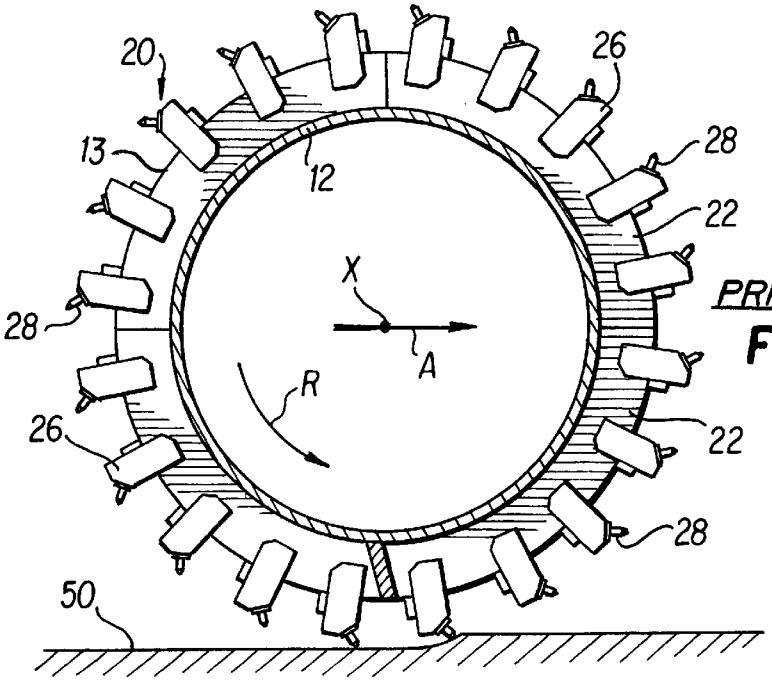
PRIOR ART FIG. 2
FIG. 2 is a sectional view taken along line 2—2 of FIG. 1 of a drum portion of a roadway surface reclaiming machine on which the present invention can be employed.

Referring now to the drawings for a detailed description of the present invention, reference is first made to prior art as depicted in FIGS. 1–2. In FIG. 1, a rotary driven cylindrical cutter 10 of a roadway surface reclaiming machine, not shown, includes a cylindrical roadway surface reclaiming drum 12 supported generally at both ends by an appropriate support means 14 and 16 and driven for rotation by a motor, not shown, through stub shafts 18. Flighting 20, which is generally formed from arcuate flighting sections 22, is attached, for instance by welding, to outer cylindrical surface portion 13 of drum 12 for continuous movement therewith. Flighting sections 22 are generally helically disposed around drum 12 at an included angle of approximately 80° with respect to cylindrical axis X of drum 12. The rotation of drum 12 is such that, as shown in FIG. 1, the lower portion of drum 12 moves out of the plane of the paper and upward toward the top of drum 12. As this motion takes place, flighting 20 acts to drive loosened roadway material located near the right side of drum 12 toward the left side, and loosened roadway material located near the left side of drum 12 toward the right side, that is, flighting 20 moves material towards lateral center portion 24 of drum 12.

The rotation of drum 12 is seen in FIG. 2 to be anticlockwise, cutting direction R about cylindrical axis X of drum 12, while the roadway surface reclaiming machine proceeds in the direction given by arrow A. A plurality of base portions 26 may be mounted to flighting sections 22, for instance by bolting or welding, and each base portion 26 includes at its radial outward extremity a cutter bit 28, typically carbide-tipped, which is directed forward in the direction of rotation of drum 12. Cutter bits 28 are caused by contact road surface 50 and, in a known manner, mine, or reclaim a controlled portion of road surface 50 and thereby leave road surface 50 substantially planar but with a slightly roughened surface texture so as to ensure superior bonding to any subsequently applied new surfacing materials. Each plane defined normal to the cylindrical axis X of drum 12 intersects two flighting sections 22 disposed on diametrically opposed sides of drum 12.

Figure 3:
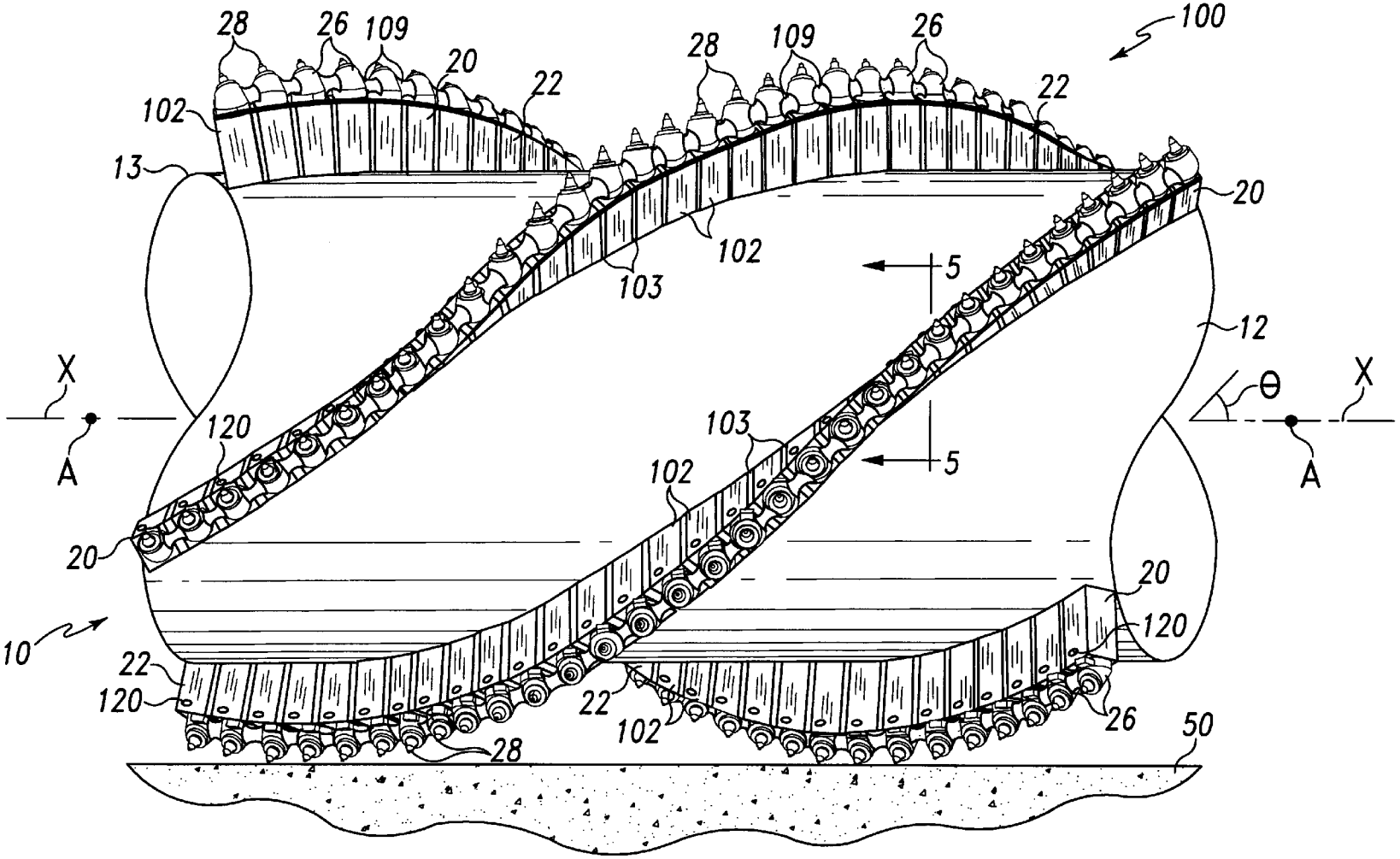
FIG. 3 is a partial, enlarged front elevational view of an apparatus for a roadway surface reclaiming drum representing the present invention and depicted with cutter bits mounted thereto.
Figure 4:
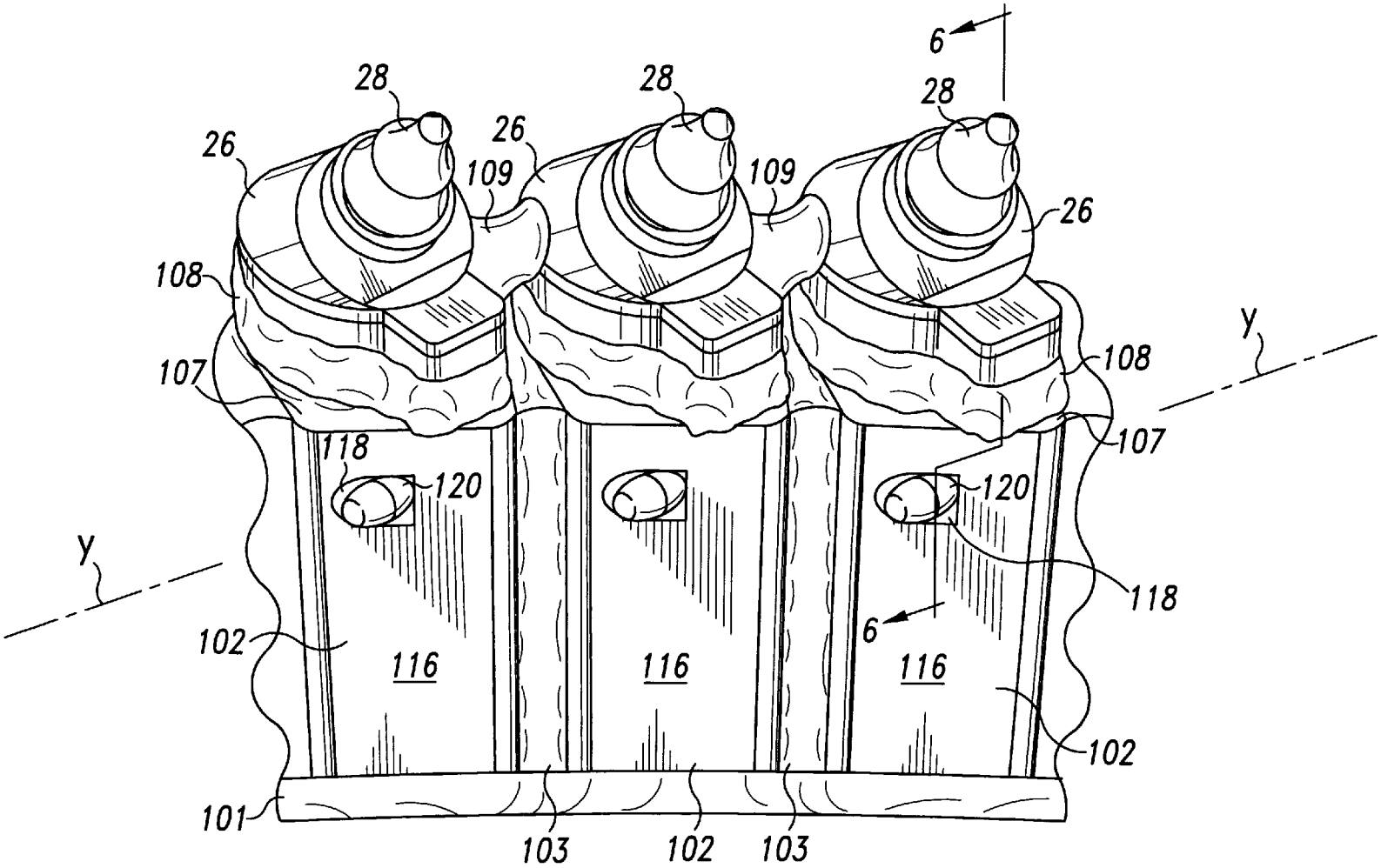
FIG. 4 is a partial, enlarged view of an apparatus for a roadway surface reclaiming drum representing the present invention and depicted with cutter bits mounted thereto.
Figure 5:
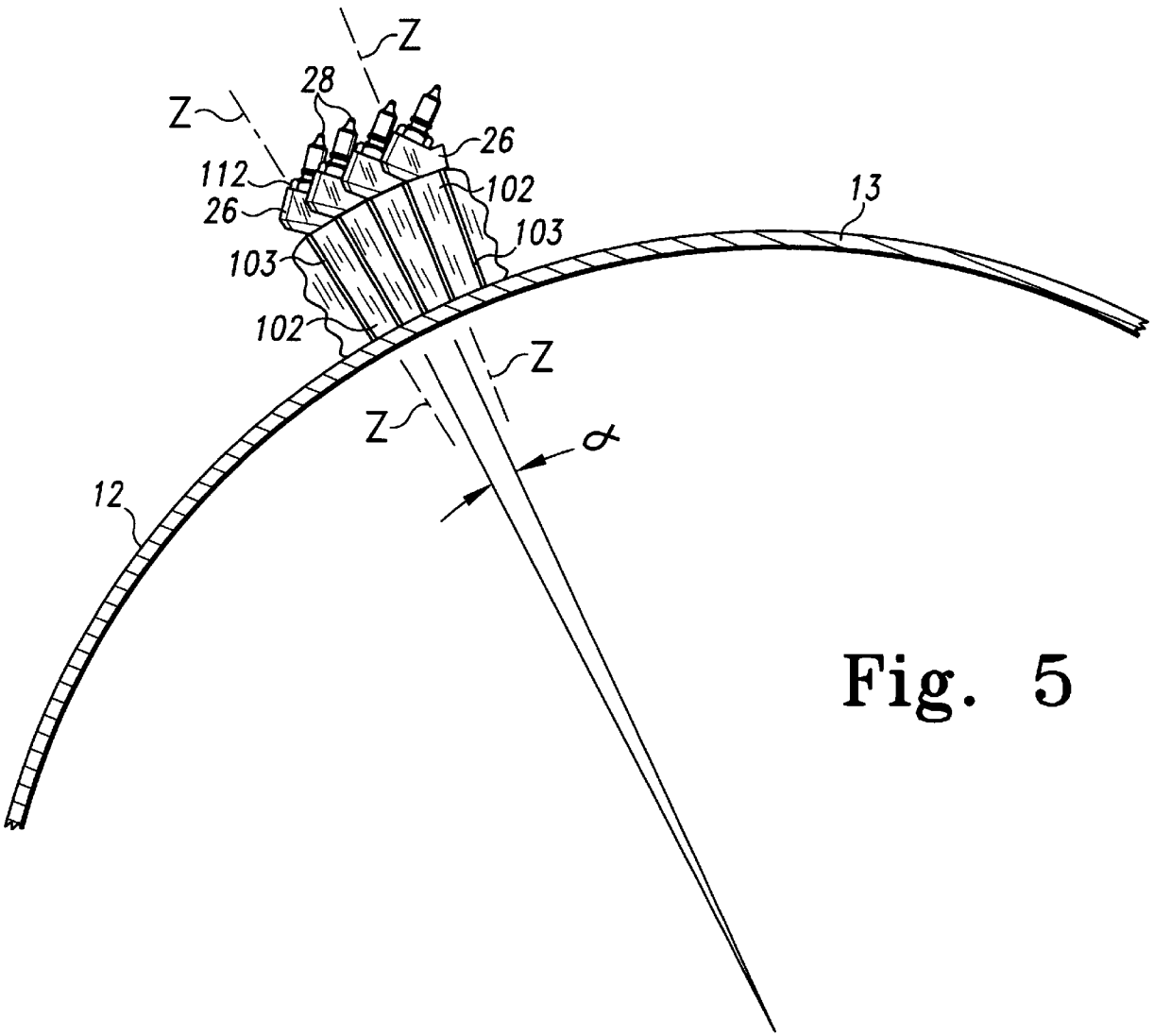
FIG. 5 is a enlarged, partial section view of an apparatus for a roadway surface reclaiming drum representing the present invention taken along line 5—5 of FIG. 3.

Referring to FIGS. 3–5, in a first embodiment, the present invention provides an apparatus 100 for use on roadway surface reclaiming drum 12, including a plurality of flighting sections 22 mounted to cylindrical surface portion 13 of drum 12, for instance by flight welds 101, in circumferentially spaced-apart relation. Flighting sections 22 are disposed to generally helically wind around cylindrical surface portion 13 at an included angle θ in the range of about 40° to about 60° with respect to cylindrical axis X of drum 12, and converge at lateral central portion 24 of cylindrical surface portion 13. Rotation of drum 12 in FIG. 3 is the same as depicted in FIGS. 1–2, that is, the lower portion of drum 12 moves out of the plane of the paper and upward towards the top of drum 12, with the roadway reclaiming machine moving out of the paper as indicated by the arrowheads A. Flighting sections 22 may be formed from a plurality of elongated, generally rectangular flighting segments 102 attached together, for instance, by segment welds 103. Further, flighting segments 102 are attached to drum 12 so that a longitudinal axis Z defined by each flighting segment 102 is disposed generally normal to cylindrical surface portion 13.

By way of example, for drum 12 having a diameter of approximately 34 inches and flighting segments 102 radially extending approximately 9 inches from cylindrical surface portion 13, the longitudinal axes Z of adjacent flighting segments 102 form a circumferential angle $\alpha$ of approximately 4° to 8° and preferably about 6°, and planes defined normal to cylindrical axis X and intersecting longitudinal axes Z of adjacent flighting segments 102 are separated by less than about 3 inches and preferably separated by about 2 inches. It will be understood that when, for example, four flighting sections 22 are utilized in the present invention as depicted in FIGS. 3–5, flighting sections 22 may be disposed on cylindrical surface portion 13 in circumferentially spaced-apart relation of approximately 90° between adjacent flighting sections 22.

As illustrated in FIGS. 3–7, a plurality of base portions 26, each including mounting surface 104 and slanted surface 105, are mounted to radially outermost portions 107 of flighting sections 22, for instance by base portion welds 108, so that mounting surfaces 104 are adjacent to radially outermost portions 107 and each base portion 26 is aligned with a flighting segment 102. Side welds 109 attach together adjacent base portions 26 and, in addition, help prevent loosened roadway material from moving between adjacent base portions 26. Each base portion 26 defines an opening 110 aligned with a longitudinal axis Z and is adapted to receive a cutter bit insert 112. Planes defined normal to cylindrical axis X defined by drum 12 intersects four flighting sections 22 disposed at approximately 90° circumferential spacings along cylindrical surface portion 13 of drum 12. Of course, it will be understood that provision of four flighting sections 22 in each plane normal to cylindrical axis X as depicted in FIGS. 3–5 is exemplary only, with the present invention contemplating the use of a plurality of flighting sections in planes normal to cylindrical axis X. For example, where three flighting sections 22 are provided, adjacent flighting sections 22 may be disposed on cylindrical surface portion 13 in circumferentially spaced-apart relation of approximately 120°.

Again with reference to FIGS. 3–5, flighting sections 22 include interior wall 116 disposed generally normal to and projecting from cylindrical surface portion 13 and defining a plurality of generally cylindrical recesses 118. A plurality of generally cylindrical teeth 120 are removably received in recesses 118, with each recess 118 defining a tooth axis Y. Tooth axes Y are disposed substantially parallel to cylindrical axis X defined by drum 12.

Figure 7:
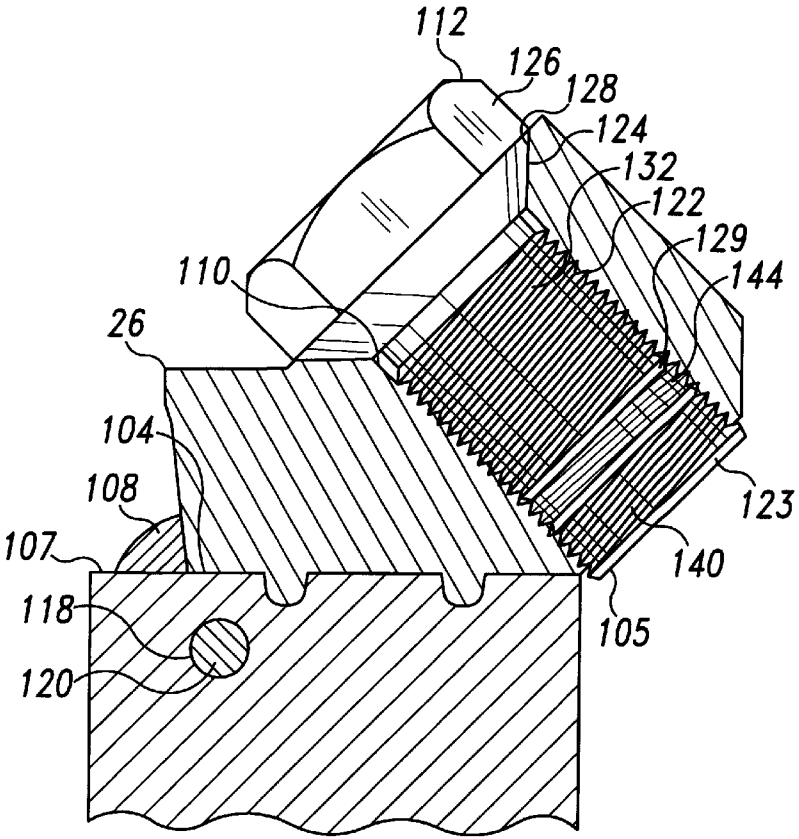
FIG. 7 is an enlarged, partial section view, taken along line 6—6 of FIG. 4, of a base portion, a cutter bit insert, and a flighting section of an apparatus for a roadway surface reclaiming drum representing the present invention, depicted with the cutter bit insert separated from a jamming fastener.
Figure 6:
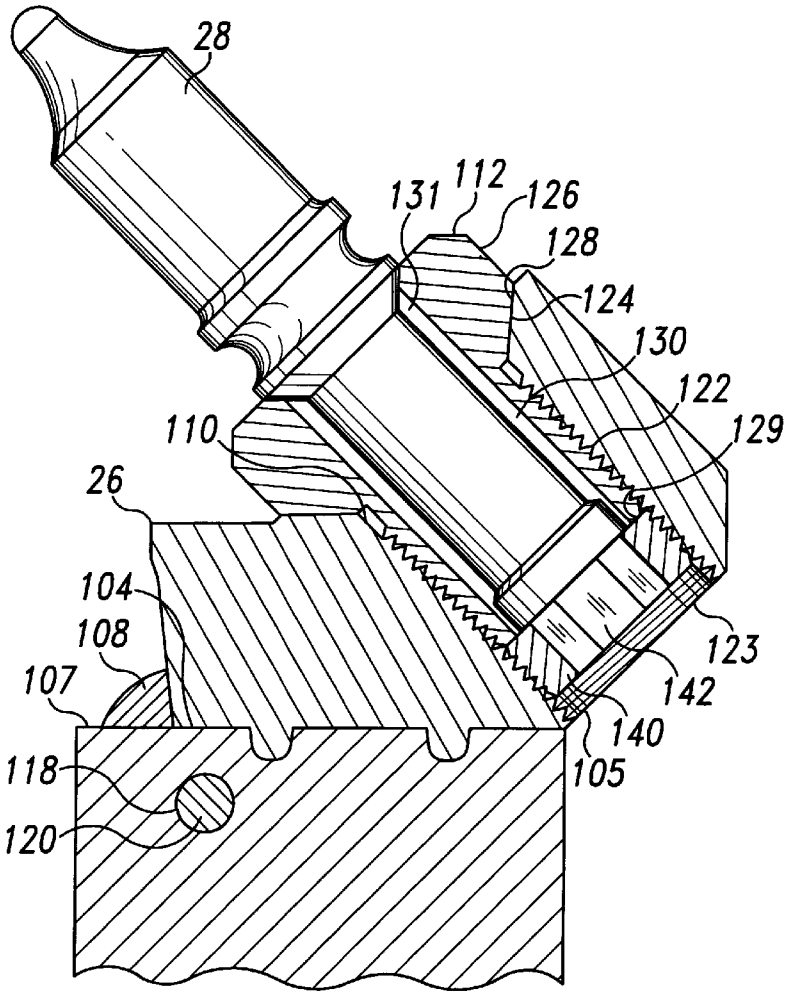
FIG. 6 is an enlarged, partial section view, taken along line 6—6 of FIG. 4, of a base portion, a cutter bit insert, and a flighting section of an apparatus for a roadway surface reclaiming drum representing the present invention, depicted with the cutter bit insert in contact with a jamming fastener, and depicted with a cutter bit.

Referring to FIGS. 6–7, opening 110 of each base portion 26 includes threads 122, lower end 123, and conical seat 124. Each cutter bit insert 112 includes gripping surface 126, conical shoulder 128, lower surface 129, defines interior bore 130, and has external threads 132 capable of threaded engagement with threads 122 of a base portion 26. Cutter bit inserts 112 are threadably engaged with base portions 26, with conical shoulders 128 of cutter bit inserts 112 disposed in wedged frictional contact against conical seats 124 of base portion 26, thereby helping to secure cutter bit inserts 112 to base portions 26 and keep external threads 132 from being under shock load of the cutting operation. Gripping surfaces 126 allow for easy access for removal of cutter bit inserts 112. Cutter bit inserts 112 may be formed of material that is not welded and therefore maintains its hardness. Interior bore 130 has upper portion 131 for removably receiving a cutter bit 28. External threads 132 and interior bore 130 of cutter bit insert 112 may be disposed substantially coaxially. Threaded jamming fastener 140 is disposed in threaded engagement with threads 122, and is positioned between lower end 123 and lower surface 129. Jamming fastener 140 may be rotated with respect to base portion 26 by use of an appropriate tool in fastener opening 142. As shown in FIG. 7, jamming fastener 140 may be threaded into base portion 26 and initially positioned proximate to lower end 123 of base portion 26. Cutter bit insert 112 may thereafter be threaded into base portion 26, with the dimensions of base portion 26, cutter bit insert 112 and jamming fastener 140 chosen so that upper volume 144 is defined between jamming fastener 140 and lower surface 129. Using an appropriate tool disposed through interior bore 130 and into fastener opening 142, jamming fastener 140 may be rotated and thereby translated towards lower surface 129 until, as depicted in FIG. 6, jamming fastener 140 contacts lower surface 129, thereby aiding in preventing relative rotational movement of cutter bit insert 112 with respect to base portion 26. In order to replace cutter bit insert 112, upon removal of cutter bit 28 from interior bore 130, the appropriate tool may again be inserted through interior bore 130 and into fastener opening 142, so that jamming fastener 140 may be rotated to translate away from contact with lower surface 129 and towards lower end 123.

It will be appreciated that, for a given optimum rotational rate of drum 12, provision of additional flighting sections 22 lying in a plane normal to the axis defined by drum 12 will increase the number of cutter bits 28 that will contact the roadway surface during each revolution of drum 12, with the result that the rate at which roadway surface is reclaimed will be significantly increased. Where a relatively greater number of flighting sections 22 lying in planes normal to cylindrical axis X of drum 12 and disposed at a given included angle are present, the average perpendicular distance between adjacent flighting sections 22 for a given size drum 12 is relatively smaller. However, movement of mined roadway material to lateral center portion 24 occurs between adjacent flighting sections 22, so that where the average perpendicular distance between adjacent flighting sections 22 is relatively smaller, the amount of mined roadway material that can be efficiently moved therebetween is also relatively less. The desirable characteristic of increasing the rate at which roadway surface is mined by utilizing additional flighting sections 22 that increase the number of cutter bits 28 contacting the roadway surface during each revolution of drum 12 may be limited by relatively smaller average perpendicular distances between adjacent flighting sections 22 in such configuration.

In addition, to further facilitate movement of loosened roadway surface between adjacent flighting sections 22 towards lateral center portion 24, and to reduce wear of flighting sections 22 through contact with loosened roadway material, teeth 120 may be provided in recesses 118 defined in interior wall 116. Upon rotation of drum 12 and flighting sections 22 in cutting direction R about cylindrical axis X, loosened roadway material is urged towards lateral center portion 24 by contact with teeth 120. As drum 12 rotates in cutting direction R about cylindrical axis X, cutter bits 28 loosen roadway surface and flighting sections 22 transport loosened roadway material axially along drum 12 and between flighting sections 22, towards lateral center portion 24. Teeth 120 act to effectuate transport of loosened roadway material between adjacent flighting sections 22, and to reduce wear of flighting sections 22 by providing a wear face for flighting sections 22. Also, by removing worn teeth 120 and replacing with new teeth 120, a renewed wear face may be provided for flighting sections 22.

Figure 9:
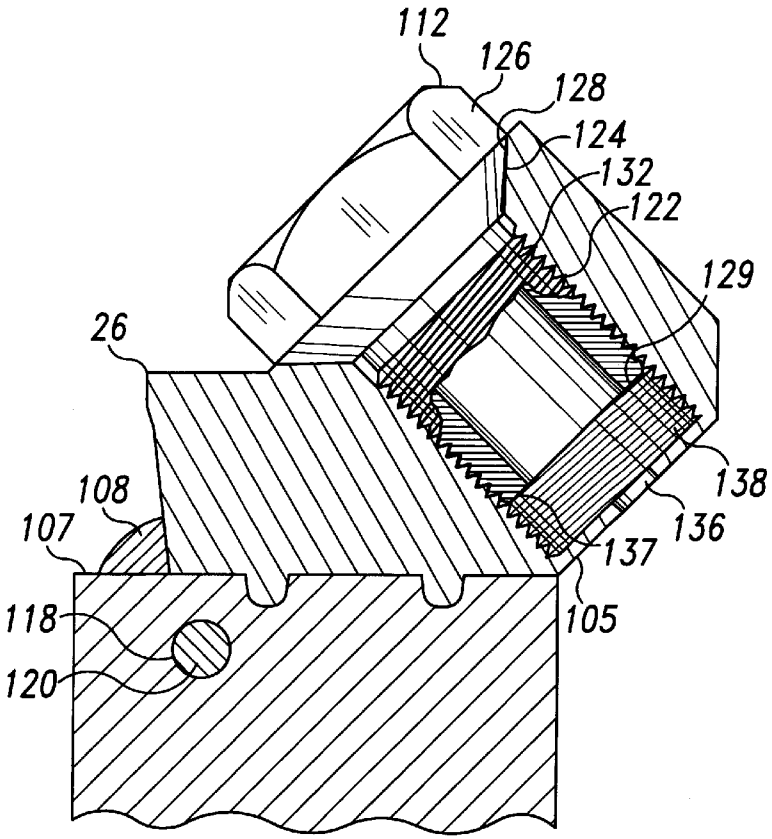
FIG. 9 is an enlarged, cutaway partial section view taken along line 6—6 of FIG. 4, of a base portion, a cutter bit insert, and a flighting section of an apparatus for a roadway surface reclaiming drum representing a second embodiment of the present invention.
Figure 8:
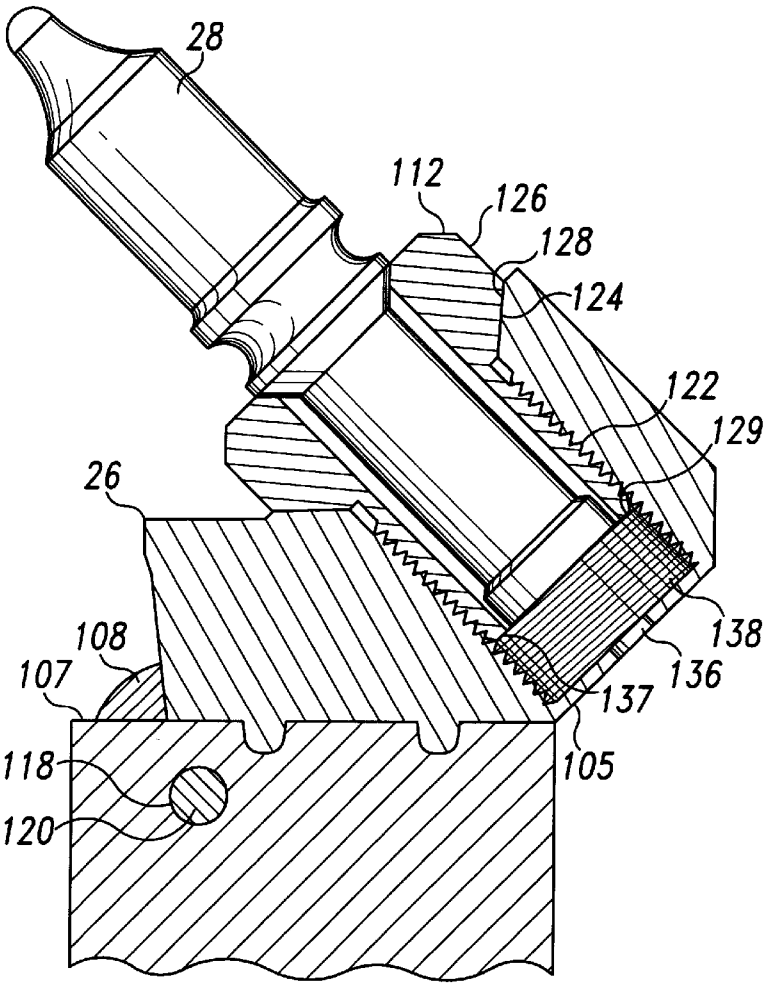
FIG. 8 is an enlarged, partial section view, taken along line 6—6 of FIG. 4, of a base portion, a cutter bit insert, and a flighting section of an apparatus for a roadway surface reclaiming drum representing a second embodiment of the present invention, depicted with a cutter bit.

As illustrated in FIGS. 8–9, in a second embodiment of the present invention, base portions 26 define access aperture 136 extending between slanted surface 105 and an interior bottom surface 137. Cutter bit inserts 112 include interior aperture 138 defined below a cutter bit 28 received in upper portion 136 of interior bore 130. Interior aperture 138 is disposed in fluid connection with access aperture 136, whereby pressurized fluid applied to access aperture 136 may bear against a cutter bit 28 received in interior aperture 138 facilitating removal of cutter bit 28 from interior aperture 138. Consequently, removal of cutter bit 28 from cutter bit insert 112 may be quickly and easily accomplished by applying compressed air or similar through access aperture 136 and into interior aperture 138, with resulting pressure bearing against and facilitating removal of cutter bit 28.

Figure 11:
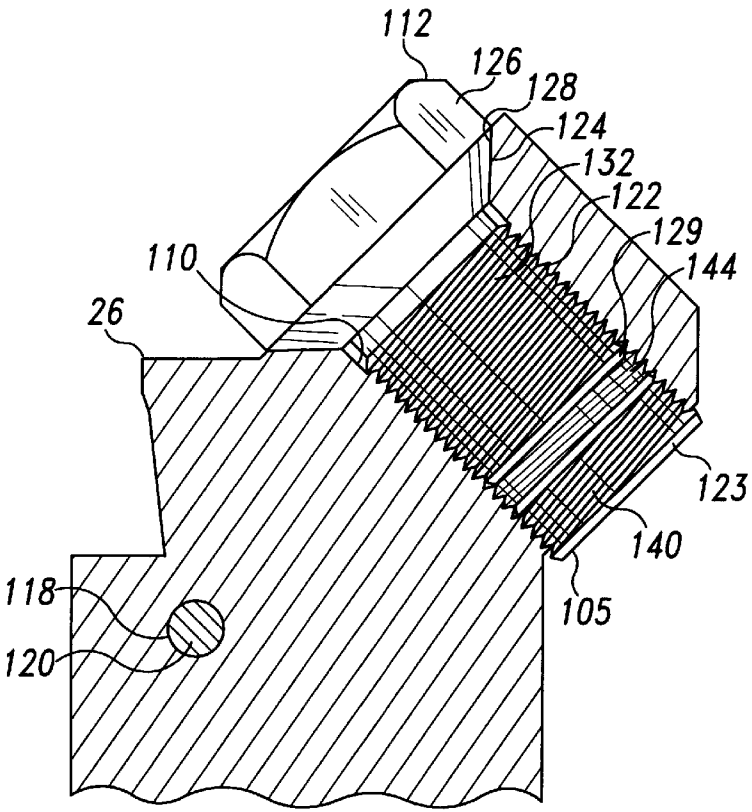
FIG. 11 is an enlarged, partial section view, taken along line 6—6 of FIG. 4, but depicting a flighting section with a flighting segment having integral base portion and a cutter bit insert of an apparatus for a roadway surface reclaiming drum representing a third embodiment of the present invention, depicted with the cutter bit insert separated from a jamming fastener.
Figure 10:
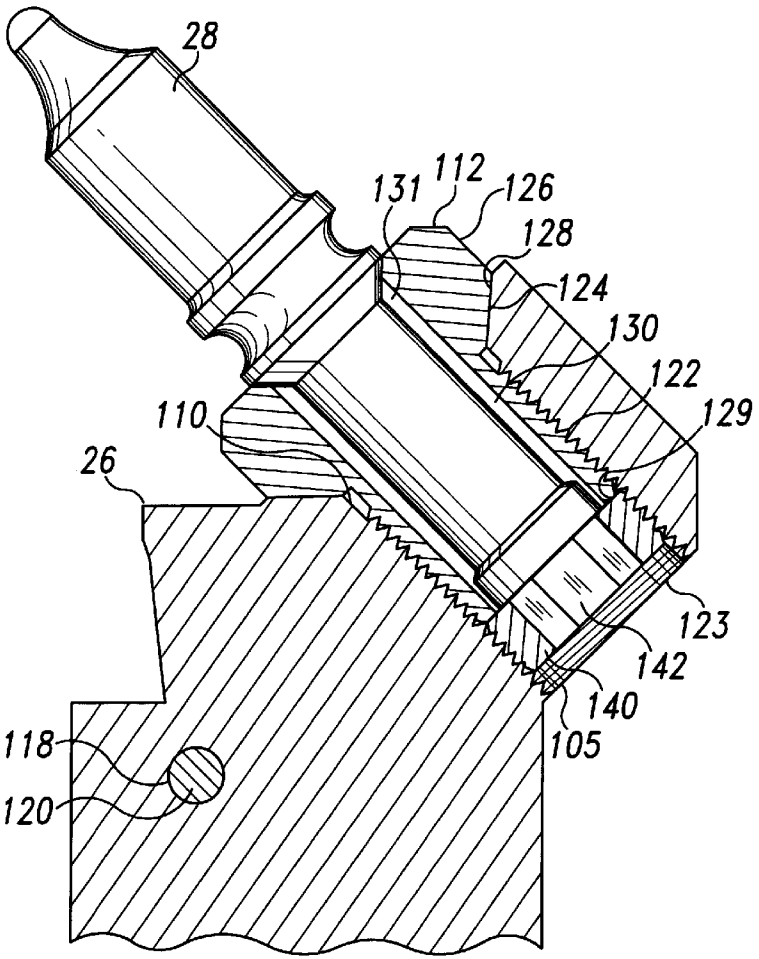
FIG. 10 is an enlarged, partial section view, taken along line 6—6 of FIG. 4, but depicting a flighting section with a flighting segment having integral base portion and a cutter bit insert of an apparatus for a roadway surface reclaiming drum representing a third embodiment of the present invention, depicted with the cutter bit insert in contact with a jamming fastener, and depicted with a cutter bit.

In a third embodiment of the present invention, illustrated in FIGS. 10–11, flighting segment 102 may include integrally formed base portion 26 whereby openings 110 are defined in flighting sections 22, so that cutter bit inserts 112 may then be threadably attached directly to flighting sections 22.

The present invention having been described in its preferred embodiments, it is clear that the present invention is susceptible to numerous modifications and embodiments within the ability of those skilled in the art and without the exercise of the inventive faculty. Accordingly, the scope of the present invention is defined as set forth by the scope of the following claims.

What is claimed is:

1. An apparatus for use on a cylindrical surface portion of a drum of a roadway surface reclaiming machine, adapted to be rotated in a cutting direction about a cylindrical axis defined by the drum, the apparatus comprising a plurality of flighting sections and means for mounting the flighting sections to the cylindrical surface portion so that the flighting sections generally helically wind around the cylindrical surface portion at an included angle of about 40° to about 60° with respect to the cylindrical axis and converge at a lateral central portion of the cylindrical surface portion, the flighting sections having a radially outermost portion defining a plurality of openings adapted to receive at least one cutter bit wherein at least one of the openings is tapped, at least one cutter bit insert defining an interior bore for receiving at least one cutter bit and having external threads capable of threaded engagement within one of the at least one tapped opening, and a threaded jamming fastener for threaded engagement within one of the at least one tapped opening and capable of bearing against one of the at least one cutter bit insert thereby securing one of the at least one cutter bit insert to at least one of the flighting sections against relative rotational movement which would cause disengagement therefrom.

2. The apparatus of claim 1 wherein adjacent openings define a circumferential angle with respect to the drum of about 4° to about 8°, and planes normal to the cylindrical axis and intersecting adjacent openings are separated by less than about 3 inches.

3. The apparatus of claim 1 wherein the external threads and the interior bore are disposed substantially coaxially.

4. An apparatus for use on a cylindrical surface portion of a drum of a roadway surface reclaiming machine, adapted to be rotated in a cutting direction about a cylindrical axis defined by the drum, the apparatus comprising a plurality of flighting sections and means for mounting the flighting section to the cylindrical surface portion so that the flighting sections generally helically wind around the cylindrical surface portion at an included angle of about 40° to about 60° with respect to the cylindrical axis and converge at a lateral central portion of the cylindrical surface portion, the flighting sections having a radially outermost portion defining a plurality of openings adapted to receive at least one cutter bit, at least one of the flighting sections including a wall disposed generally normal to and projecting from the cylindrical surface portion and defining a plurality of recesses, and a plurality of teeth received in the recesses and capable of reducing frictional contact between portions of reclaimed roadway surface and the flighting sections during rotation of the drum in the cutting direction.

5. The apparatus of claim 4 wherein the recesses are generally cylindrical, and each recess defines a tooth axis disposed substantially parallel to the cylindrical axis.

6. The apparatus of claim 4 wherein the teeth are removably received in the recesses.

7. An apparatus for use on a cylindrical surface portion of a drum of a roadway surface reclaiming machine, adapted to be rotated in a cutting direction about a cylindrical axis defined by the drum, the apparatus comprising:

a plurality of flighting sections, each having a radially outermost portion;

a plurality of base portions, each mounted to the outermost portion of one of the flighting sections and to at least one other of the base portions and each defining at least one opening adapted to receive a cutter bit insert; and means for mounting the flighting sections to the cylindrical surface portion so that the flighting sections generally helically wind around the cylindrical surface portion at an included angle of about 40° to about 60° with respect to the cylindrical axis and converge at a lateral central portion of the cylindrical surface portion.

8. The apparatus of claim 7 wherein adjacent openings define a circumferential angle with respect to the drum of about 4° to about 8°, and planes defined normal to the cylindrical axis and intersecting adjacent openings are separated by less than about 3 inches.

9. An apparatus for use on a cylindrical surface portion of a drum of a roadway surface reclaiming machine, adapted to be rotated in a cutting direction about a cylindrical axis defined by the drum, the apparatus comprising:

a plurality of flighting sections each having a radially outermost portion, at least one of the flighting sections including a wall disposed generally normal to and projecting from the cylindrical surface portion and defining a plurality of recesses;

a plurality of teeth received in the recesses and capable of reducing frictional contact between portions of reclaimed roadway surface and the flighting sections during rotation of the drum in the cutting direction;

a plurality of base portions, each mounted to the outermost portion of one of the flighting sections and each defining at least one opening adapted to receive a cutter bit insert; and means for mounting the flighting sections to the cylindrical surface portion so that the flighting sections generally helically wind around the cylindrical surface portion at an included angle of about 40° to about 60° with respect to the cylindrical axis and converge at a lateral central portion of the cylindrical surface portion.

10. The apparatus of claim 9 wherein the recesses are generally cylindrical, and each recess defines a tooth axis disposed substantially parallel to the cylindrical axis.

11. The apparatus of claim 9 wherein the teeth are removably received in the recesses.

12. An apparatus for use on a cylindrical surface portion of a drum of a roadway surface reclaiming machine, adapted to be rotated in a cutting direction about a cylindrical axis defined by the drum, the apparatus comprising:

a plurality of flighting sections, each having a radially outermost portion and at least one of the flighting sections including a wall disposed generally normal to and projecting from the cylindrical surface portion and defining a plurality of recesses;

a plurality of teeth received in the recesses and capable of reducing frictional contact between portions of reclaimed roadway surface and the flighting sections during rotation of the drum in the cutting direction;

a plurality of base portions, each mounted to the outermost portion of one of the flighting sections and to at least one other base portion, and defining at least one opening adapted to receive a cutter bit insert; and means for mounting the flighting sections to the cylindrical surface portion so that the flighting sections generally helically wind around the cylindrical surface portion at an included angle of about 40° to about 60° with respect to the cylindrical axis and converge at a lateral central portion of the cylindrical surface portion.

13. The apparatus of claim 12 wherein adjacent openings define a circumferential angle with respect to the drum of about 4° to about 8°, and planes defined normal to the cylindrical axis and intersecting adjacent openings are separated by less than about 3 inches.

14. The apparatus of claim 12 wherein the recesses are generally cylindrical, and each recess defines a tooth axis disposed substantially parallel to the cylindrical axis.

15. The apparatus of claim 12 wherein the teeth are removably received in the recesses.

16. An apparatus for use on a cylindrical surface portion of a drum of a roadway surface reclaiming machine, adapted to be rotated in a cutting direction about a cylindrical axis defined by the drum, the apparatus comprising:

a flighting section mounted to the cylindrical surface portion and defining a tapped opening;

a cutter bit insert defining an interior bore for receiving at least one cutter bit and having external threads capable of threaded engagement within the tapped opening; and a threaded jamming fastener for threaded engagement within the tapped opening and capable of bearing against the cutter bit insert thereby securing the cutter bit insert to the flighting section against relative rotational movement which would cause disengagement therefrom.

17. The apparatus of claim 16 wherein the external threads and the interior bore of the cutter bit insert are disposed substantially coaxially.

18. An apparatus for use on a cylindrical surface portion of a drum of a roadway surface reclaiming machine, adapted to be rotated in a cutting direction about a cylindrical axis defined by the drum, the apparatus comprising:

a flighting section mounted to the cylindrical surface portion;

a base portion mounted to the flighting section and defining a tapped opening;

a cutter bit insert defining an interior bore for receiving at least one cutter bit and having external threads capable of threaded engagement within the tapped opening; and a threaded jamming fastener for threaded engagement within the tapped opening and capable of bearing against the cutter bit insert thereby securing the cutter bit insert to the base portion against relative rotational movement which would cause disengagement therefrom.

19. The apparatus of claim 18 wherein the external threads and the interior bore of the cutter bit insert are disposed substantially coaxially.

20. An apparatus for use on a cylindrical surface portion of a drum of a roadway surface reclaiming machine, adapted to be rotated in a cutting direction about a cylindrical axis defined by the drum, the apparatus comprising:

a flighting section mounted to the cylindrical surface portion;

a base portion mounted to the flighting section and defining a tapped opening and an access aperture; and a cutter bit insert defining an interior aperture for receiving at least one cutter bit and having external threads capable of threaded engagement with the tapped opening so that the interior aperture is disposed in fluid connection with the access aperture, whereby pressurized fluid applied to the access aperture may bear against at least one cutter bit received in the interior aperture facilitating removal of at least one cutter bit from the interior aperture.

21. The apparatus of claim 20 wherein the external threads and the interior aperture of the cutter bit insert are disposed substantially coaxially.

* * * * *

UNITED STATES PATENT AND TRADEMARK OFFICE

CERTIFICATE OF CORRECTION

PATENT NO. : 5,842,747

DATED : December 1, 1998

INVENTOR(S) : Winchester E. Latham

It is certified that error appears in the above-identified patent and that said Letters Patent is hereby corrected as shown below:

On the title page item [75], delete "Latham E. Winchester" and insert therefor --Winchester E. Latham--.

Signed and Sealed this

Thirtieth Day of March, 1999

*Attest:*

*Attesting Officer*

Q. TODD DICKINSON

*Acting Commissioner of Patents and Trademarks*